US010670247B2

(12) United States Patent
Ansems et al.

(10) Patent No.: US 10,670,247 B2
(45) Date of Patent: Jun. 2, 2020

(54) LIGHTING DEVICE AND METHOD

(71) Applicant: SIGNIFY HOLDING B.V., Eindhoven (NL)

(72) Inventors: Johannes Petrus Maria Ansems, Eindhoven (NL); Jochen Renaat Van Gheluwe, Eindhoven (NL); Peter Johannes Martinus Bukkems, Eindhoven (NL); Alexander Jacobus Mariette Van Neer, Eindhoven (NL); Bartel Marinus Van De Sluis, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/301,898

(22) PCT Filed: May 18, 2017

(86) PCT No.: PCT/EP2017/061994
§ 371 (c)(1),
(2) Date: Nov. 15, 2018

(87) PCT Pub. No.: WO2017/202689
PCT Pub. Date: Nov. 30, 2017

(65) Prior Publication Data

US 2019/0293270 A1 Sep. 26, 2019

(30) Foreign Application Priority Data

May 27, 2016 (EP) ..... 16171618

(51) Int. Cl.
*F21S 4/00* (2016.01)
*F21V 21/22* (2006.01)
(Continued)

(52) U.S. Cl.
CPC ..... *F21V 21/22* (2013.01); *F21S 4/24* (2016.01); *F21S 4/28* (2016.01); *F21V 14/02* (2013.01);
(Continued)

(58) Field of Classification Search
CPC ..... F21V 21/22; F21S 4/24; F21S 4/28
(Continued)

(56) References Cited

U.S. PATENT DOCUMENTS 6,431,726 B1 * 8/2002 Barton ..... F21V 17/007 362/217.05
7,726,839 B2 6/2010 Chien
(Continued)

FOREIGN PATENT DOCUMENTS

CN 103775865 A 5/2014
EP 2426408 A1 3/2012
(Continued)

OTHER PUBLICATIONS http://www.world-semi.com, WS2812 Intelligent Control LED Integrated Light Source, pp. 1-5.

*Primary Examiner* — Matthew J. Peerce
(74) *Attorney, Agent, or Firm* — Daniel J. Piotrowski

(57) ABSTRACT

A lighting device has at least two lighting strips, which are slidable relative to each other and overlap in a region of overlap so that the overall length may be adjusted. The combined light intensity per unit length of the lighting strips in the region of overlap corresponds to the light intensity per unit length of the first and second lighting strips outside the region of overlap. This arrangement makes sure the combined light output in the region of overlap is the same as where the lighting strips do not overlap. In this way, the
(Continued)

overall device is reversibly and repeatedly extendable and retractable and maintains a relatively constant light output per unit length.

9 Claims, 7 Drawing Sheets

(51) Int. Cl.

| | |
|---|---|
| ***F21S 4/24*** | (2016.01) |
| ***F21S 4/28*** | (2016.01) |
| ***F21V 14/02*** | (2006.01) |
| ***F21V 21/005*** | (2006.01) |
| *F21Y 103/10* | (2016.01) |
| *F21Y 115/10* | (2016.01) |
| *F21Y 101/00* | (2016.01) |

(52) U.S. Cl.
CPC ..... *F21V 21/005* (2013.01); *F21Y 2101/00* (2013.01); *F21Y 2103/10* (2016.08); *F21Y 2115/10* (2016.08)

(58) Field of Classification Search
USPC ..... 362/220
See application file for complete search history.

(56) References Cited

U.S. PATENT DOCUMENTS

| | | | | |
|---|---|---|---|---|
| 2008/0266856 | A1 | 10/2008 | Chien | |
| 2012/0238663 | A1 | 9/2012 | Iverson et al. | |
| 2013/0033185 | A1 | 2/2013 | Burrows et al. | |
| 2013/0141914 | A1* | 6/2013 | Lai | F21V 21/22 362/249.03 |
| 2019/0049100 | A1* | 2/2019 | Seligman | F21V 21/22 |

FOREIGN PATENT DOCUMENTS

| | | | |
|---|---|---|---|
| FR | 3019020 | A1 | 10/2015 |
| JP | 2011070825 | A | 4/2011 |
| WO | WO2011086162 | A2 | 7/2011 |
| WO | WO2011118354 | A1 | 9/2011 |

* cited by examiner

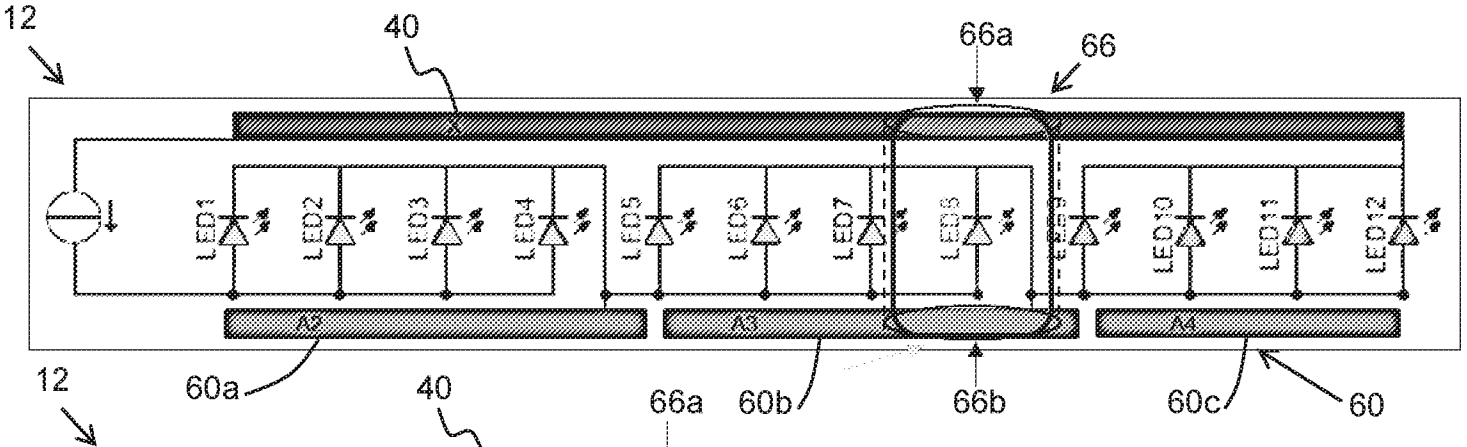
FIG. 7A
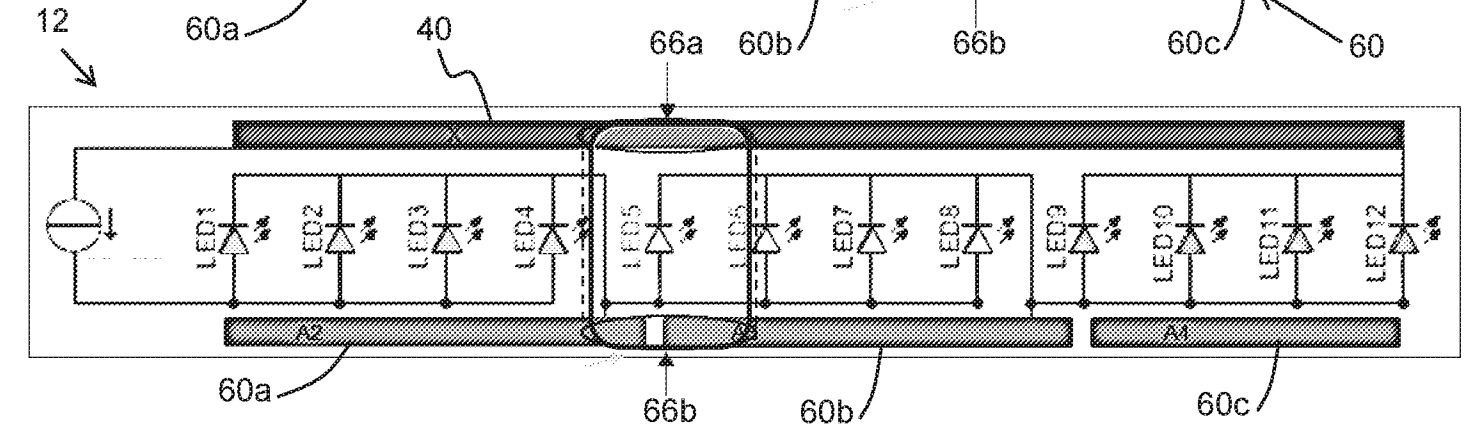
FIG. 7B
FIG. 7

LIGHTING DEVICE AND METHOD

CROSS-REFERENCE TO PRIOR APPLICATIONS

This application is the U.S. National Phase application under 35 U.S.C. § 371 of International Application No. PCT/EP2017/061994, filed on May 18, 2017, which claims the benefit of European Patent Application No. 16171618.8, filed on May 27, 2016. These applications are hereby incorporated by reference herein.

FIELD OF THE INVENTION

The present invention relates to a lighting device comprising a plurality of point lighting strips, for example each comprising light sources such as LEDs at regular intervals.

BACKGROUND OF THE INVENTION

Lighting using point light sources such as LED lighting is rapidly gaining popularity because of its long lifetime and low power consumption. In addition, due to the configurability of LED lighting, such lighting is routinely integrated in lighting systems that deliver configurable lighting to an environment in which the lighting system is installed. Such lighting systems may include lighting systems in which a plurality of different light sources are interconnected using wireless or wired communication technologies.

An example of LED lighting for use in such lighting systems is LED lighting strips, in which the LEDs are typically distributed along a strip at regular distances from each other, which regular distance is commonly referred to as the pitch of the LEDs. As such LED lighting may be used in a wide variety of environments having different lighting requirements, different LED lighting strips may require LEDs at different pitches in order to deliver the required lighting requirements. Consequently, different LED lighting strips need to be manufactured for such different requirements, which is costly to the manufacturer of such LED lighting and lighting systems including such LED lighting.

Linear lighting elements such as lighting strips are used in multiple applications and are also increasingly finding their way into people's homes. Various manufacturers provide fixed length LED lighting strips in a rigid housing, which facilitates handling and mounting. They may also incorporate optical or light shaping elements (e.g. a diffuse exit window). The disadvantage of these products is that they have a fixed length and cannot be cut to size.

Other LED lighting strip products that are becoming commonplace are flexible LED strips. Their flexibility allows for compact packaging and easy shipping and allows the user to conform the LED lighting strip to the object it is to be applied to, for example by having a bendable strip. In practice however the strips are mostly used as linear elements. An additional advantage of flexible LED lighting strips is that they may, in many cases, be cut-to measure at discrete intervals, i.e. an excess part can be cut off. The cut-off part is cast away.

Example applications of such lighting products are cove lighting, underneath cupboards, behind stair handrails, under kitchen cupboards, etc. For most of these applications, the length required for the lighting strip to exactly fit the object or structural element to which the lighting strip will be applied is not available. Fitting the lighting strip to the exact length of the object or structure however greatly enhances the aesthetic characteristics.

For rigid LED lighting strips, this typically means the light effect does not extend to the edges of the object giving dark edges, or multiple LED lighting strips are used for longer objects with spaces in between. This results in darker areas at those locations. This is aesthetically not optimal and can often appear cheaper or the lighting can look like an afterthought.

Flexible cut-to-measure LED strips can be cut to the required length, but for many users cutting into the LED strip is not desired: Apart from the fact that it means cutting into an electrical device, it is also irreversible and the excess part cannot be reused. This irreversible cutting process, combined with the fact that the strips are usually fixed on the surface with an adhesive tape, prohibits a user to try out the lighting strip in different locations and orientations, before deciding on a final location. After installation, the strip is hard to remove and cannot be easily reused in another location. If it can be removed, it can no longer be used for longer lengths.

One way to avoid the cutting process is simply to overlap lighting strips to create a reduced overall length. However, this gives non-uniformity of the brightness, for example if both of the overlapping strips create light at the overlap area. For example, two 1 meter lighting strips may be used to fill a space of 1.5 m, by overlapping them over 0.5 m in the middle. This creates more light in the overlapping section and hence a non-homogeneous light effect), which also implies a higher and unnecessary energy consumption.

There is therefore a need for a linear lighting element which can be adjusted to length, but without requiring cutting to length, and which still provides a uniform light output.

U.S. patent application 2013/141914 A1 discloses a lamp including a first light device and a second light device. The first light device includes a first cover and a first light strip received in the first cover. The second light device included a second cover and a second light strip received in the second cover. The second light device is movably mounted to the first light device. A light emitting area of the second light strip of the second light device is changeable according to movement of the second light device relative to the first light device whereby a total light emitting area of the LED lamp is adjustable.

SUMMARY OF THE INVENTION

According to an aspect, there is provided a lighting device comprising:

a first lighting strip;

a second lighting strip, each of the first and second lighting strips comprising an elongate light emitting region, wherein the lighting emitting regions of the first and second lighting strips at least partially overlap in a region of overlap, and the first and second lighting strips are slidable relative to each other so that the region of overlap is adjustable, thereby to adjust the overall length of the lighting device, wherein each lighting strip has a first lighting emitting portion outside the region of overlap and a second light emitting portion in the region of overlap, wherein the combined light intensity per unit length of the second light emitting portions of the first and second lighting strips in the region of overlap corresponds to the light intensity per unit length of the first lighting portions of the first and second lighting strips.

This arrangement makes sure that the combined light output in the region of overlap is the same as where the lighting strips do not overlap. In this way, the overall device is reversibly and repeatedly extendable and retractable. A user may thus easily fit the lighting device to the exact length required by a lighting application without needing to cut the device (and typically throw away the cut-off part). The lighting device is energy efficient, since regions of excessive brightness are avoided. A relatively constant light output per unit length is enabled to give a homogeneous lighting effect.

Note that the overlap of the lighting strips may in some examples be one over the other, but it may in other examples be side by side.

The combined light intensity "corresponds to" that in the regions without overlap. By this is meant that the combined light intensity is closer to the light intensity outside the regions of overlap than if both lighting strips were simply normally illuminated. The combined light intensity in the region of overlap may be the same as outside the region of overlap. However, relative sliding may give non-regular spacing of lighting elements between ends of the region of overlap and the adjacent regions without overlap, so the intensity per unit length may vary slightly at those edges. Preferably, within the region of overlap (and excluding any edge effect from the neighboring regions outside the region of overlap), the light intensity per unit length is within 20% of the light intensity per unit length outside the region of overlap, and more preferably within 10%, and even more preferably within 5%. This is what is meant by "corresponds to".

Each lighting strip may be flexible or rigid. A flexible arrangement gives more freedom to apply the lighting device to non-flat areas. A rigid arrangement is more robust and enables a more sturdy and easy to use sliding mechanism to be provided.

In one set of examples, the first and second lighting strips may each be driven to a half intensity level per unit length at the region of overlap. In this way, both lighting strips are used to provide light in the region of overlap, but with a reduced (50%) intensity so that the overall intensity remains the same.

One way to implement this control is for each lighting strip to comprise an array of current driven lighting elements, wherein the lighting elements in the first light emitting portions are connected in series, and the lighting elements in the second light emitting portion of the first lighting strip are in series with one another but in parallel with a series connection of the lighting elements in the second light emitting portion of the second lighting strip. Thus, there are two branches in parallel in the region of overlap. This halves the current flowing.

If the lighting elements have a linear relationship of intensity vs. current, each branch will then contribute 50% light intensity compared to outside the region of overlap. Of course, if there is not a perfectly linear relationship, the combined light intensity may differ slightly, but still will overall "correspond" (as explained above) to the light intensity per unit length outside the region of overlap.

A first sliding electrical connection may be provided between an end of the first lighting strip and a movable point along the second lighting strip and a second sliding electrical connection may be provided between an opposite end of the second lighting strip and a movable point along the first lighting strip.

Between these two sliding electrical connections, the region of overlap is defined, and the two branches of lighting elements are in parallel. This provides simple automatic control of the series-parallel connection using sliding contacts.

In another set of examples, the first lighting strip is driven off at the region of overlap. In this way, only one of the two lighting strips (arbitrarily denoted the second lighting strip) is used for the region of overlap. The first is driven off to save power.

One way to implement this is for each lighting strip to comprise an array of current driven lighting elements, wherein the first lighting strip comprises a sliding electrical connection coupled to the second lighting strip, which electrical connection bypasses the lighting elements in the region of overlap.

This bypass for example comprises a shorting function which shorts out those lighting elements in the region of overlap.

Each lighting strip may comprise a plurality of sets of parallel lighting elements, the sets in series, wherein the electrical connection bypasses one of more sets of the lighting elements. This provides a combined series and parallel arrangement. It means the voltage variation is reduced as between different slider settings, so that the requirements on the current source are relaxed.

The lighting device may comprise a lower lighting strip and an upper lighting strip, wherein the upper lighting strip slides over the lower lighting strip and carries a sliding contact arrangement which makes contact with the lower lighting strip. This provides a simple to use and simple to manufacture structure.

In the examples above, sliding electrical contacts are used to control the connection or driving of the lighting strips. An alternative is to provide a sensor for sensing the region of overlap and a lighting controller, wherein the lighting controller controls the lighting strips in dependence on the sensed region of overlap. There are then different alternative ways to detect the region of overlap, either using automatic sensing or by user input.

There may be three or more lighting strips, with a region of overlap between each adjacent pair of lighting strips. Thus, the lighting device is not limited to two strips, and multiple strips may be combined.

Furthermore, when there are three or more lighting strips, three (or more) lighting strips may overlap at each region of overlap. This means the range of sizes may be extended. For example, a single design may be able to fit a space from a first dimension to three times that dimension. Even greater amounts of overlap may be provided.

Each lighting strip for example comprises an array of LEDs with regular spacing along the lighting strip.

Examples in accordance with another aspect provide a method of configuring a lighting device, which comprises a first lighting strip and a second lighting strip, each of the first and second lighting strips comprising an elongate light emitting region, wherein the method comprises:

providing the lighting emitting regions of the first and second lighting strips with at least a partial overlap in a region of overlap, by sliding the first and second lighting strips relative to each other thereby to adjust the overall length of the lighting device; and driving the lighting strips with a combined light intensity per unit length in the region of overlap which corresponds to the light intensity per unit length of the first and second lighting strips outside the region of overlap.

BRIEF DESCRIPTION OF THE DRAWINGS

Embodiments of the invention are described in more detail and by way of non-limiting examples with reference to the accompanying drawings, wherein:

FIG. 7 shows a second example of a circuit for implementing a control scheme as shown in FIG. 2 or 3;

DETAILED DESCRIPTION OF THE EMBODIMENTS

Figure 1:
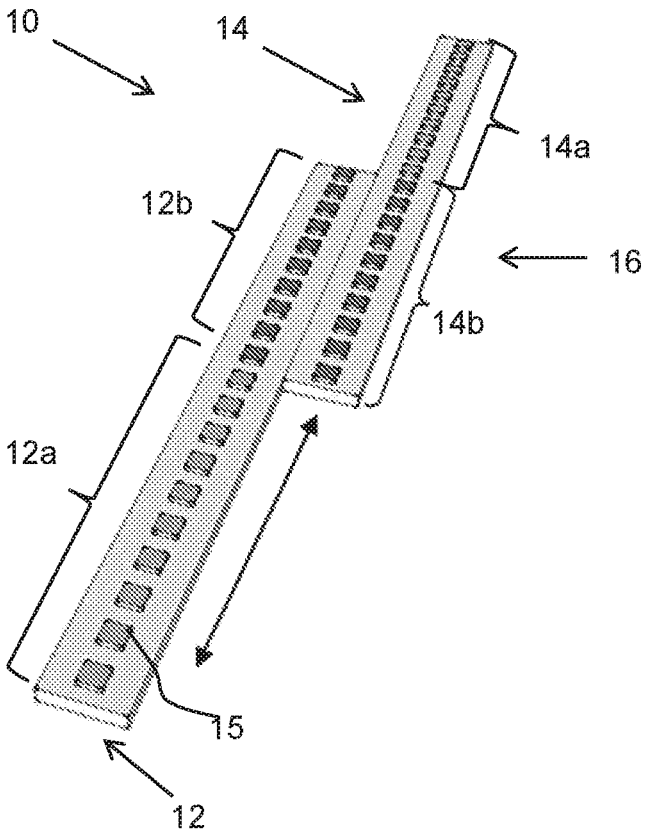
FIG. 1 shows a first arrangement of two lighting strips with control of the light output in a region of overlap.

It should be understood that the Figures are merely schematic and are not drawn to scale. It should also be understood that the same reference numerals are used throughout the Figures to indicate the same or similar parts.

The invention provides a lighting device with at least two lighting strips, which are slidable relative to each other and overlap in a region of overlap so that the overall length may be adjusted. The combined light intensity per unit length of the lighting strips in the region of overlap corresponds to the light intensity per unit length of the first and second lighting strips outside the region of overlap. This means the combined light output in the region of overlap is the same as where the lighting strips do not overlap. In this way, the overall device is reversibly and repeatedly extendable and retractable and maintains a relatively constant light output per unit length.

FIG. 1 schematically depicts a lighting device 10 according to an embodiment. The lighting device 10 comprises two lighting strips 12, 14, each comprising an elongate light emitting region along which an array of discrete lighting elements 15 are mounted. In the example shown, the array is a 1×n array, but it may be an array with multiple rows and columns. The lighting emitting regions partially overlap side-by-side in a region 16 of overlap. The lighting strips are slidable relative to each other so that the size of the region 16 may be adjusted and hence the overall length is adjustable.

The lighting strips each have a first lighting emitting portion 12*a*, 14*a* outside the region 16 of overlap and a second light emitting portion 12*b*, 14*b* in the region 16 of overlap.

In the example of FIG. 1, in the region 16 of overlap, the lighting elements are driven to 50% brightness, so that in combination, the light intensity (per unit length) in the region of overlap corresponds to the light intensity (per unit length) of the first light emitting portions 12*a*, 14*s* of the first and second lighting strips.

Figure 2:
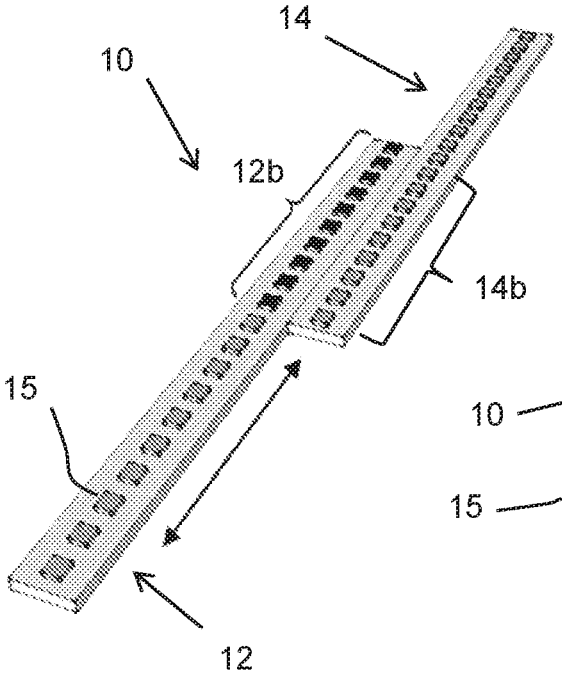
FIG. 2 shows a first arrangement of two lighting strips with control of the light output in a region of overlap.

In the example of FIG. 2, in the region 16 of overlap, the lighting elements in the second portion 12*b* of the first lighting strip 12 are turned off and the lighting elements in the second portion 14*b* of the second lighting strip are driven to 100% brightness. Again, in combination, the light intensity (per unit length) in the region of overlap corresponds to the light intensity (per unit length) of the first lighting portions 12*a*, 14*s* of the first and second lighting strips.

Figure 3:
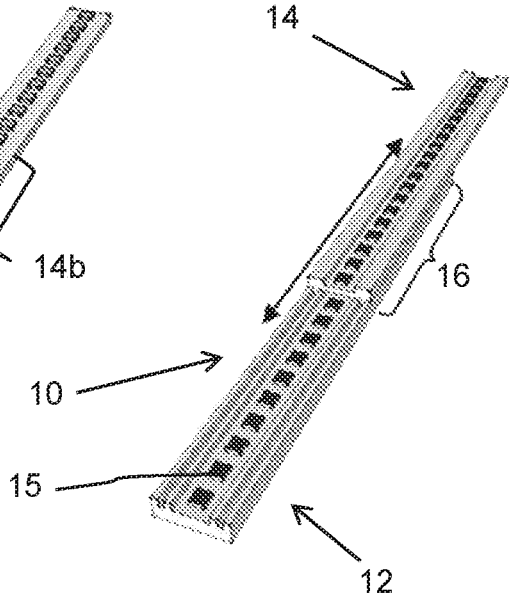
FIG. 3 shows a first arrangement of two lighting strips with control of the light output in a region of overlap.

FIGS. 1 and 2 show the overlap in the side-by-side direction, but as shown in FIG. 3, one lighting strip may overlap over the other.

A first example will be described in more detail, based on the approach of FIG. 1.

The two lighting strips for example comprise rigid linear LED lighting strips which slide next to each other. The sliding mechanism is implemented in such a way that the total lighting device stays sufficiently rigid in both the retracted and the extended state. The lighting strips are limited in their sliding movement so that they cannot be shifted beyond the point where they become detached.

With the lighting strips side-by-side, all LEDs are exposed (i.e. visible) at all times. To ensure a constant radiant flux (light output) per unit length along the overall device, irrespective of the state of extension, the brightness is reduced in the region of overlap as explained above. This region has double the number of LEDs per unit length, so they are dimmed in the region of overlap section by 50%.

Figure 4:
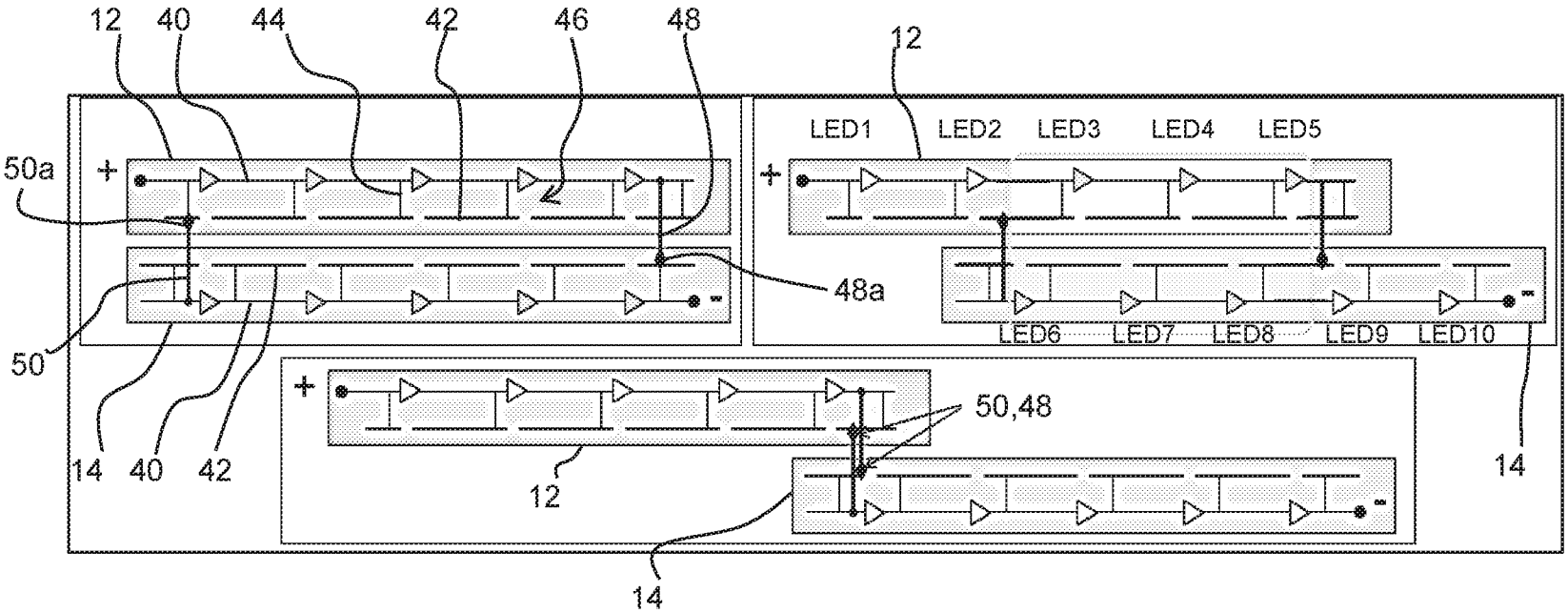
FIG. 4 shows a circuit for implementing a control scheme as shown in FIG. 1.

One way to achieve this electrically is shown in FIG. 4. FIG. 4 shows the two lighting strips 12, 14 in three different sliding positions.

Each lighting strip 12, 14 comprises a series connection of LEDs along a first electrical rail 40. A second rail 42 is in parallel with the first rail 40 but is discontinuous. The input to each LED along the first rail connects to the second rail by a short 44, but there is a discontinuity 46 along the second rail after the short. This means that the connection between each adjacent pair of LEDs along the first rail connects to one isolated section of the second rail 42.

The first rail 40 of one lighting strip 12 is connected to a (positive) input terminal (+) and the first rail 40 of the other lighting strip 14 is connected to a (negative) output terminal (−).

Two sliding electrical contacts 48, 50 are provided. A first sliding electrical contact 48 is between an end (the end near the negative terminal) of the first rail 40 of the first lighting strip 12 and a movable point 48*a* along the second rail 42 of the second lighting strip 14. A second sliding electrical contact 50 is between an opposite end (the end near the positive terminal) of the first rail of the second lighting strip 14 and a movable point 50*a* along the second rail 42 of the first lighting strip.

The electrical connections are arranged such that for the space between them, the LEDs form two parallel branches. The electrical connections each form a ladder path between the first rails 40 of the two lighting strips. The ladder path includes one of the contacts 48, 50 and one of the shorts 44.

This can be seen in the second image, where the two lighting strips 12,14 have an intermediate level of overlap. The electrical connection between the input terminal (+) and the output terminal (−) includes LEDs 1 and 2 in series, LEDs 3, 4 and 5 in series but in parallel with the series connection of LEDs 6, 7, and 8, and then LEDs 9 and 10 in series.

The LEDs in the overlap region thus form two parallel branches. As a result these LED each receive half of the current of the total device whereas the other LEDs receive the full current. Consequently the overlapping LEDs emit only half of the flux of the other LEDs.

The first and last image in FIG. 4 shows the most retracted configuration and the most extended configuration, respectively. The extended configuration has approximately double the length of the retracted configuration.

Figure 5:
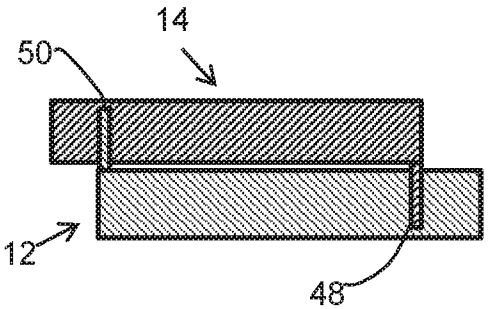
FIG. 5 shows in schematic form a mechanical sliding arrangement for use with the circuit of FIG. 4.
Figure 5:
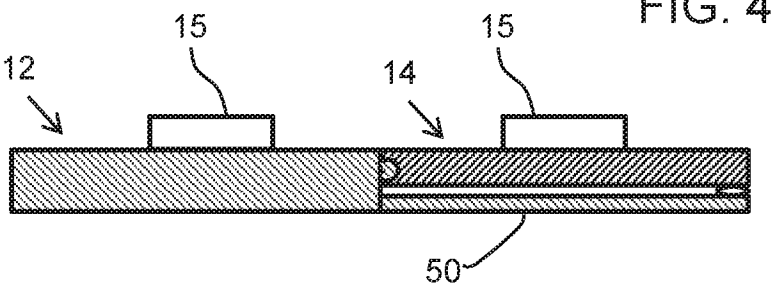

FIG. 5 shows a mechanical arrangement. The two lighting strips 12, 14 are interlocked side by side so they can slide relative to each other. The left image shows a cross sectional view and shows the contact 50 extending between the two lighting strips. The right image shown a view from beneath and shows both contacts 48, 50. The overlap region is between the contacts 48, 50.

In this example, the positive pole of the power supply or driver is connected to one side of the device and the negative pole is connected to the other side of the device. If all connections need to be on one side, an additional sliding contact may be used, to extend from negative terminal back to the location of the positive terminal.

A second example will be described in more detail, based on the approach of FIG. 3.

Figure 6:
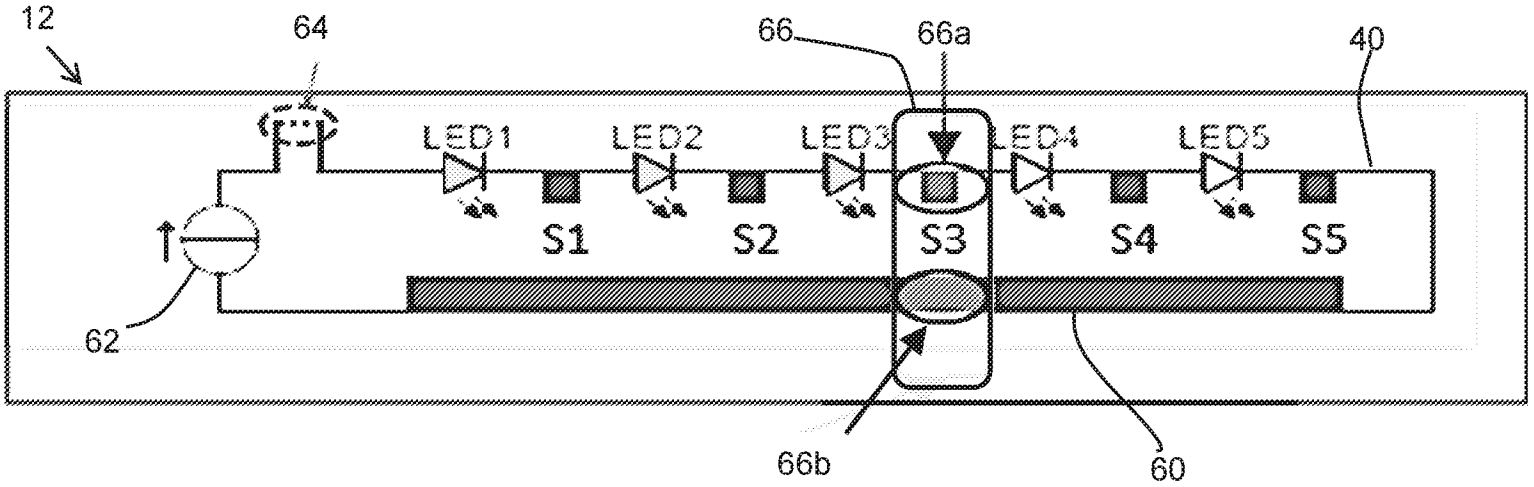
FIG. 6 shows a first example of a circuit for implementing a control scheme as shown in FIG. 2 or 3.

FIG. 6 shows the lighting strip 12 which is to form the lower lighting strip. The top lighting strip 14 is unaltered so that all LEDs are at driven at full intensity (depending on the control input).

The LEDs in the bottom lighting strip are obscured by the top lighting strip even if they are all illuminated. Although this automatically ensures a constant light output per unit length, this is not desirable since the covered LEDs still use power (i.e. wasted energy) and also generate unwanted heat.

The bottom overlapped LEDs are instead turned off.

A simple electrical circuit to achieve such an effect is shown in FIG. 6. The LEDs are again along a first rail 40. A continuous path is formed by a second return rail 60. A current source 62 drives a current around the path and also around the top lighting strip in series. The top lighting strip connects in the path at the connectors 64.

By creating a short 66 at an intermediate position along the lower lighting strip 12, the current flows via the short 66 and the LEDs after the short are switched OFF, while the LEDs before the short are unaffected. The short 66 connects between a contact pad 66*a* (named S3 in FIG. 6) of the rail 40 and a portion 66*b* of the return rail 60. In this way, the short 66 bypasses the lighting elements in the region of overlap. The region of overlap is thus to the right of the short 66.

The fact that a current source is used means the current through each (not-shorted) LED remains constant independent of the number of LEDs in the string (within a certain voltage range of the current source). In the example of FIG. 6 a short is introduced at position S3 by means of a galvanic sliding contact carried by the top lighting strip (not shown in FIG. 6). As a result, the light intensity of LEDs 1, 2 and 3 will stay the same while LEDs 4 and 5 will switch OFF.

The sliding contact is attached to the top LED lighting strip in such a way that all LEDs in the bottom element covered by the top element are switched OFF.

Note that in FIG. 6 the LEDs of the top lighting strip are for clarity reasons not included. In practice the electrical connection 64 to the top lighting strip 14 may be implemented by two more sliding contacts (not drawn).

A possible problem with the arrangement of FIG. 6 is that the current source 62 needs to be capable of quite a large voltage range. The more LEDs that are connected in series, the higher the voltage required. The current source thus needs to handle both the voltage of the case where all LEDs in both strip elements are ON, and about half the voltage when the device is completely retracted and only the LEDs in the top element are ON. This is especially relevant for longer lengths with larger numbers of LEDs.

A solution to this problem is for each lighting strip to comprise a plurality of sets of parallel lighting elements, with the sets in series, wherein the electrical connection bypasses one of more sets of the lighting elements. This provides combinations of series and parallel connections with a current source. Practically this means that each single LED in FIG. 6 is replaced with a number of LEDs electrically placed in parallel.

In this way, the maximum voltage can be lowered (by a factor equal to the number of LEDs placed in parallel per segment) and standard low cost current source drivers can be used. A simple conductive sliding contact moving across the track can still be used to make shortcuts in the current pad.

FIG. 7 shows this arrangement with the sliding contact 66 (having connection points 66*a*, 66*b* to the first rail 40 and return rail 60). The return rail is discontinuous with a section 60*a*, 60*b*, 60*c* for each parallel bank of LEDs.

FIG. 7 shows three segments of 4 LEDs, placed in parallel, with the four banks in series with each other. The first bank is LEDs 1 to 4, the second bank is LEDs 5 to 8 and the third bank is LEDs 9 to 12. As with FIG. 6, the circuit only shows the lower lighting strip 12.

The sliding contact 66 is connected to the end of the top lighting strip 14 which slides over the bottom lighting strip 12.

In FIG. 7A, the slider 66 is located over LED 8. This means the top lighting strip covers LEDs 8 to 12. The slider creates a short from the section 60*b* of the return rail 60 to the continuous rail 40 effectively bypassing and thus switching off the parallel LED segment which is associated with the sections further downstream, i.e. section 60*c*.

The only compromise in using a combination of serial and parallel circuits in this way is that some LEDs within the LED segment encompassing the slider 66 may still be switched on while they are covered by the top element (e.g. LED 8 in FIG. 7A). This introduces only a small loss in efficiency comparable to the power consumed by maximum N−1 LEDs (where N is the number of LEDs per segment).

In FIG. 7B the slider 66 is moved to the position at LED 5, shorting the return rail section 60*a* (and also section 60*b*) with the rail 40. This bypasses the segment associated with the sections further downstream, i.e. sections 60*b* and 60*c*. In this case no unnecessary power is wasted. All LEDs covered by the top element are now switched OFF. LEDs 1 to 4 remain ON.

The circuits and slider are designed in such a way that a LED segment is only switched off when all of its LEDs are covered by the top strip element. Note that in the example this is achieved by locating the associated section of the return rail 60 under the LEDs of the next segment along the device. For example, the slider 66 needs to reach the position of LED 4 (as in FIG. 7B) before the LEDs 5 onwards are turned off by making contact with the section 60*a* of the return rail.

Figure 8:
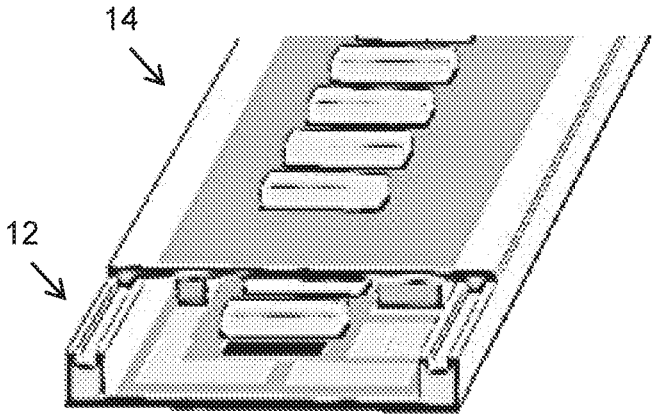
FIG. 8 shows in schematic form a mechanical sliding arrangement for use with the circuit of FIG. 7.
Figure 9:
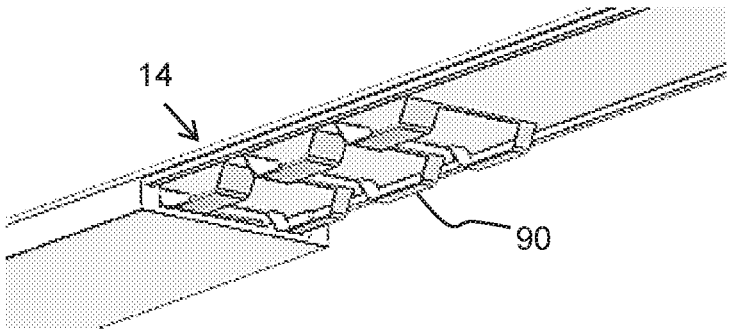
FIG. 9 shows electrical contacts used in the sliding arrangement of FIG. 8.

FIG. 8 shows an example of an arrangement with one lighting strip 14 over the other 12, with movement along mechanical rails. As shown in FIG. 9, the underside of the top lighting strip 14 has projecting contacts 90 for making connections between rails of the lighting strip 12 beneath.

The examples above show two lighting strips. There may however be three or more lighting strips.

Figure 10:
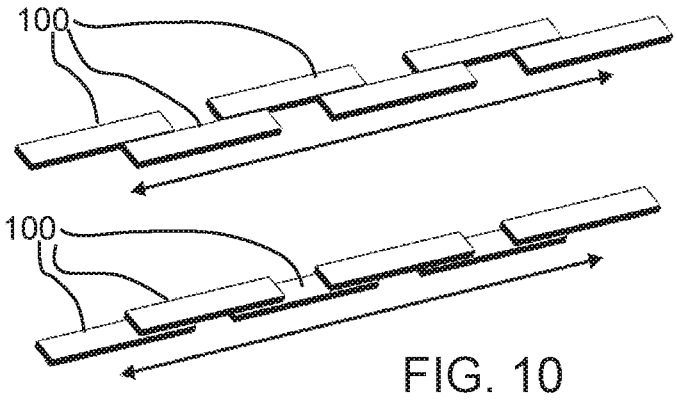
FIG. 10 shows how more lighting strips may be used.

FIG. 10 shows an arrangement with six lighting strips 100, with a region of overlap between each adjacent pair of lighting strips. One image shows lighting strips arranged side to side and the other shows lighting strips one above the other at each junction.

In these arrangements, the extended configuration is at most double the length of the retracted configuration.

Figure 11:
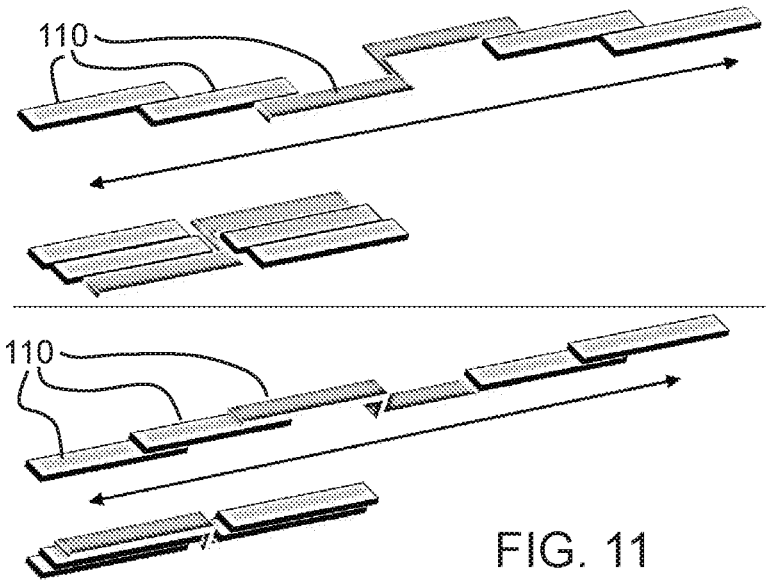
FIG. 11 how the range of extension and retraction may be increased by using overlap of more than two lighting strips.

FIG. 11 shows an arrangement with six lighting strips 110, with a region of overlap between three lighting strips. One image shows lighting strips arranged side to side and the other shows three lighting strips stacked above each other at each junction. By allowing an overlap between three or more lighting strips, the length extension is increased. For example, for the arrangement of FIG. 11, the extended configuration is almost three times the length of the refracted configuration. At the overlap (whether between two or more lighting strips) the intensity is controlled in the manner explained above to maintain a substantially constant intensity along the overall device.

The examples above are all based on a mechanical contact design. However, the LEDs may instead be individually addressable (or addressable in groups). This is for example the case if each LED has an IC which drives the LED based on a data signal. The LED lighting strip can then be driven and addressed using 2 power lines (cathode and anode) and 1 or more data lines.

Such LED driving approaches are well known. This allows the overlapping of LEDs to be specifically dimmed or switched off via software (via the data/driving signal). This involves determining the region of overlap and communicating this to the LED controller. In general, a sensing function is provided for sensing the region of overlap and a lighting controller controls the lighting strips in dependence on the sensed region of overlap.

Several options are available which can be either fully automatic or require user input for the sensing function.

For an automatic implementation, a sliding contact may be used to determine the overlap region e.g. by measuring a resistance. The LED controller automatically then uses this information to adjust the content for the lighting strip or strips to dim or turn off (depending on the embodiment) the lighting elements in the overlap region.

For an implementation having user input, after installation a user performs a commissioning step where indication is given via a user interface of the overlap region. For example, this may be by repeatedly pressing a button on the driver or remote to make the LEDs turn on one by one. Just before the overlapping section is reached, the user may then finalize the commissioning step therefore indicating the non-overlapping LED and the controller switches on the LED lighting strip and turns off or dims the LEDs in the overlap region.

A touch strip or series of buttons may instead be integrated along the LED lighting strip allowing the user to indicate the overlap region during a commissioning step.

For all examples above, the fixation/mounting of the lighting device is independent of the solution chosen. It can be glued with adhesive tape, although the reversible nature of the retraction/extension implies that removing the linear light element after it has been installed should preferably be relatively easy and not damage the lighting device. Possible ways of mounting are therefore brackets which can be glued or screwed in place and in which the linear lighting element can be clicked or magnetic attachment (e.g. the backside of the linear lighting carries magnets which can be clicked on a ferromagnetic metal strip, which on its turn in screwed or glued in place).

This thus provides a linear (LED) lighting element, that is reversibly and repeatedly extendable and retractable and enables a constant luminous flux (light output) per unit length, irrespective of the state of extension/retraction. The constant light output of course ignores high frequency flicker. The solution is energy efficient Dependent on the specific implementation, the desired light output for the device can be pre-determined, user selectable with a user interface on the lighting device or using a connected user interface device such as a remote control or smart device.

The examples above show rigid lighting strips. This makes the mechanical connection easier to form, but the strips may instead be flexible. For example, when a controller is calibrated to control the lighting strips in the desired manner, there is no need for any particular mechanical coupling between the lighting strips. They may instead simply be fixed in place with the desired overlap.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The invention can be implemented by means of hardware comprising several distinct elements. In the device claim enumerating several means, several of these means can be embodied by one and the same item of hardware. The mere fact that certain measures are recited in mutually different dependent claims does not indicate that a combination of these measures cannot be used to advantage.

Following hereafter is an itemized list of clauses that relate to the present disclosure:

1. A lighting device comprising:

a first lighting strip (12);

a second lighting strip (14), each of the first and second lighting strips comprising an elongate light emitting region, wherein the lighting emitting regions of the first and second lighting strips at least partially overlap in a region (16) of overlap, and the first and second lighting strips are slidable relative to each other so that the region (16) of overlap is adjustable, thereby to adjust the overall length of the lighting device, wherein each lighting strip has a first lighting emitting portion (12*a*, 14*a*) outside the region of overlap and a second light emitting portion (12*b*, 14*b*) in the region of overlap, wherein the combined light intensity per unit length of the second light emitting portions of the first and second lighting strips in the region (16) of overlap corresponds to the light intensity per unit length of the first lighting portions (12*a*, 14*a*) of the first and second lighting strips.

2. A lighting device according to clause 1, wherein each lighting strip (12, 14) is flexible.

3. A lighting device according to clause 1, wherein each lighting strip (12, 14) is rigid.

4. A lighting device according to any preceding clause, wherein the first and second lighting strips (12, 14) are each driven to a half intensity level per unit length at the region of overlap.

5. A lighting device according to clause 4, wherein each lighting strip comprises an array of current driven lighting elements (15), wherein the lighting elements in the first light emitting portions (12*a*, 14*a*) are connected in series, and the lighting elements in the second light emitting portion (12*b*) of the first lighting strip are in series but in parallel with a series connection of the lighting elements in the second light emitting portion (14*b*) of the second lighting strip.

6. A lighting device according to clause 5, comprising a first sliding electrical connection (48) between an end of the first lighting strip and a movable point along the second lighting strip and a second sliding electrical connection (50) between an opposite end of the second lighting strip and a movable point along the first lighting strip.

7. A lighting device according to any one of clauses 1 to 3, wherein the first lighting strip (12) is driven off at the region (16) of overlap.

8. A lighting device according to clause 7, wherein each lighting strip comprises an array of current driven lighting elements (15), wherein the first lighting strip comprises a sliding electrical connection (66) coupled to the second lighting strip, which electrical connection bypasses the lighting elements in the region of overlap.

9. A lighting device according to clause 8, wherein each lighting strip comprises a plurality of sets of parallel lighting elements, the sets in series, wherein the electrical connection bypasses one of more sets of the lighting elements.

10. A lighting device according to any one of the clauses 7 to 9, comprising a lower lighting strip (12) and an upper lighting strip (14), wherein the upper lighting strip slides over the lower lighting strip and carries a sliding contact arrangement (90) which makes contact with the lower lighting strip.

11. A lighting device according to any one of the clauses 1 to 3 or 7 comprising a sensor for sensing the region of overlap and a lighting controller, wherein the lighting controller controls the lighting strips in dependence on the sensed region of overlap.

12. A lighting device according to any preceding clause, comprising three or more lighting strips (100), with a region of overlap between each adjacent pair of lighting strips.

13. A lighting device according to any preceding clause, comprising three or more lighting strips (110), wherein three lighting strips overlap at each region of overlap.

14. A lighting device according to any preceding clause, wherein each lighting strip comprises an array of LEDs (15) with regular spacing along the lighting strip.

15. A method of configuring a lighting device, which comprises a first lighting strip (12) and a second lighting strip (14), each of the first and second lighting strips comprising an elongate light emitting region, wherein the method comprises:

providing the lighting emitting regions of the first and second lighting strips with at least a partial overlap in a region (16) of overlap, by sliding the first and second lighting strips relative to each other thereby to adjust the overall length of the lighting device; and driving the lighting strips with a combined light intensity per unit length in the region (16) of overlap which corresponds to the light intensity per unit length of the first and second lighting strips outside the region of overlap.

The invention claimed is:

1. A lighting device comprising:

a first lighting strip;

a second lighting strip, each of the first and second lighting strips comprising an elongate light emitting region, wherein the lighting emitting regions of the first and second lighting strips at least partially overlap in a region of overlap, and the first and second lighting strips are slidable relative to each other so that the region of overlap is adjustable, thereby to adjust the overall length of the lighting device, wherein each lighting strip has a first lighting emitting portion outside the region of overlap and a second light emitting portion in the region of overlap, wherein the combined light intensity per unit length of the second light emitting portions of the first and second lighting strips in the region of overlap corresponds to the light intensity per unit length of the first lighting portions of the first and second lighting strips, wherein the first lighting strip is driven off at the region of overlap, and wherein each lighting strip comprises an array of current driven lighting elements, wherein the first lighting strip comprises a sliding electrical connection coupled to the second lighting strip, which electrical connection bypasses the lighting elements of the first lighting strip in the region of overlap.

2. A lighting device as claimed in claim 1, wherein each lighting strip is flexible.

3. A lighting device as claimed in claim 1, wherein each lighting strip is rigid.

4. A lighting device as claimed in claim 1, wherein each lighting strip comprises a plurality of sets of parallel lighting elements, the sets in series, wherein the electrical connection bypasses one of more sets of the lighting elements.

5. A lighting device as claimed in claim 1, comprising a lower lighting strip and an upper lighting strip, wherein the upper lighting strip slides over the lower lighting strip and carries a sliding contact arrangement which makes contact with the lower lighting strip.

6. A lighting device as claimed in claim 1, comprising three or more lighting strips, with a region of overlap between each adjacent pair of lighting strips.

7. A lighting device as claimed in claim 1, comprising three or more lighting strips, wherein three lighting strips overlap at each region of overlap.

8. A lighting device as claimed in claim 1, wherein each lighting strip comprises an array of LEDs with regular spacing along the lighting strip.

9. A method of configuring a lighting device, which comprises a first lighting strip and a second lighting strip, each of the first and second lighting strips comprising an elongate light emitting region, wherein the method comprises:

providing the lighting emitting regions of the first and second lighting strips with at least a partial overlap in a region of overlap, by sliding the first and second lighting strips relative to each other thereby to adjust the overall length of the lighting device; and driving the lighting strips with a combined light intensity per unit length in the region of overlap which corresponds to the light intensity per unit length of the first and second lighting strips outside the region of overlap, wherein the first lighting strip is driven off at the region of overlap, and wherein each lighting strip comprises an array of current driven lighting elements, wherein the first lighting strip comprises a sliding electrical connection coupled to the second lighting strip, which electrical connection bypasses the lighting elements of the first lighting strip in the region of overlap.

* * * * *